US010557228B2

(12) United States Patent
Leibman

(10) Patent No.: US 10,557,228 B2
(45) Date of Patent: Feb. 11, 2020

(54) ADDITIVE DELIVERY ASSEMBLY FOR AN APPLIANCE

(71) Applicant: Haier US Appliance Solutions, Inc., Wilmington, DE (US)

(72) Inventor: Alexander B. Leibman, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 62 days.

(21) Appl. No.: 15/945,780

(22) Filed: Apr. 5, 2018

(65) Prior Publication Data

US 2019/0309463 A1 Oct. 10, 2019

(51) Int. Cl.
*F26B 7/00* (2006.01)
*D06F 58/20* (2006.01)

(52) U.S. Cl.
CPC ..... *D06F 58/20* (2013.01)

(58) Field of Classification Search
CPC ..... G01F 13/005; G01F 13/006; G01F 13/001
See application file for complete search history.

(56) References Cited

U.S. PATENT DOCUMENTS

| | | | | |
|---|---|---|---|---|
| 3,402,576 A * | 9/1968 | Krupsky | ..... | D06F 33/02 68/4 |
| 3,743,140 A * | 7/1973 | Sauerbrey | ..... | B65B 37/20 222/63 |
| 4,642,908 A | 2/1987 | Brenner | | |
| 2013/0042653 A1* | 2/2013 | Acharya | ..... | D06F 39/02 68/12.18 |

FOREIGN PATENT DOCUMENTS

| | | | | |
|---|---|---|---|---|
| EP | 3015589 A1 | 5/2016 | | |
| GB | 2277266 A * | 10/1994 | ..... | A61L 9/122 |
| KR | 100739202 B1 | 7/2007 | | |

* cited by examiner

*Primary Examiner* — Jason Lau
(74) *Attorney, Agent, or Firm* — Dority & Manning, P.A.

(57) ABSTRACT

An appliance that includes an additive delivery assembly is provided. The additive delivery assembly includes features that deliver a controlled amount of additive to a chamber of an appliance. Methods for delivering an additive to a chamber of an appliance are also provided.

20 Claims, 9 Drawing Sheets

ADDITIVE DELIVERY ASSEMBLY FOR AN APPLIANCE

FIELD OF THE INVENTION

The present subject matter relates generally to consumer appliances and more particularly to additive delivery assemblies for such appliances.

BACKGROUND OF THE INVENTION

In some instances, it is desirable to introduce or deliver an additive into a chamber of an appliance. As one example, a cleaning agent additive may be delivered to a wash chamber defined by a tub of a washing machine appliance, e.g., to clean the tub and a wash basket rotatably mounted within the tub. As another example, an aromatic agent additive may be delivered to a drying chamber defined by a drum of a dryer appliance, e.g., to provide a desirable aroma to the articles placed within the drum. One challenge with delivering additives into a chamber defined by an appliance is that conventional additive delivery assemblies have typically been unable to control the amount of additive delivered to the chamber. Accordingly, many times the amount of additive delivered to the chamber by such conventional additive delivery assemblies is not satisfactory. For instance, too little additive may be delivered to the chamber or too much additive may be delivered to the chamber. The lack of control of the additive delivery amount may be an inconvenience to consumers.

Accordingly, an appliance that includes an additive delivery assembly that addresses one or more of the challenges noted above would be desirable.

BRIEF DESCRIPTION OF THE INVENTION

Aspects and advantages of the invention will be set forth in part in the following description, or may be apparent from the description, or may be learned through practice of the invention.

In one exemplary embodiment, an additive delivery assembly for an appliance is provided. The appliance defines a chamber in which an airflow is configured to flow. The additive delivery assembly includes a tank defining a tank volume configured for receipt of an additive. The additive delivery assembly also includes a roller configured for rotation about an axis of rotation, the roller comprising a surface that defines a reference point that is exposed to the additive disposed within the tank when the roller is in a first position and the reference point of the surface is exposed to the chamber when the roller is in a second position, and wherein when the roller is rotated about the axis of rotation from the first position to the second position, the additive disposed on the surface of the roller at the reference point is exposed to the airflow flowing in the chamber of the appliance.

In another exemplary embodiment, a method for delivering an additive disposed within a tank to a chamber defined by an appliance is provided. The method includes rotating a roller about an axis of rotation from a first position to a second position, the roller comprising a surface that defines a reference point, the reference point of the surface is submerged in the additive disposed within the tank when the roller is rotated about the axis of rotation to the first position and the reference point of the surface is exposed to the chamber when the roller is rotated about the axis of rotation to the second position. Further, the method includes flowing an airflow within the chamber across the reference point of the surface of the roller when the roller is rotated to the second position such that additive disposed on the reference point of the surface of the roller is exposed to the airflow.

In yet another exemplary embodiment, a method for delivering an additive disposed within a tank to a chamber defined by an appliance is provided. The method includes rotating a roller about an axis of rotation continuously for a predetermined time and at a rotational speed, wherein at least a portion of the roller is positioned within the tank and submerged in the additive and at least a portion of the roller is positioned external to the tank and within the chamber. The method also includes flowing an airflow within the chamber across the surface of the roller positioned external to the tank when the roller is rotated about the axis of rotation continuously for the predetermined time and at the rotational speed such that the additive disposed on the surface of the roller is exposed to the airflow.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
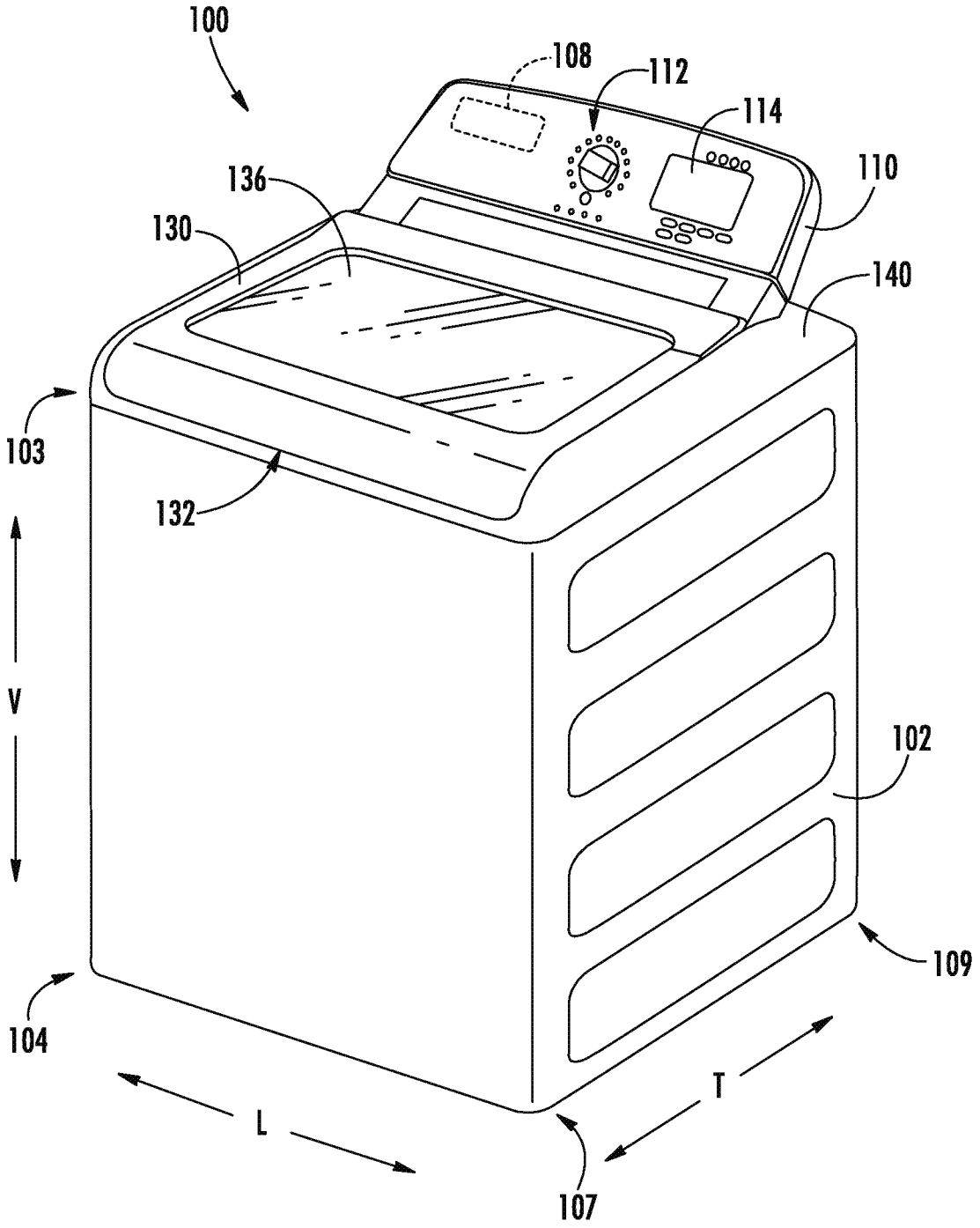
FIG. 1 provides a perspective view of a washing machine appliance according to an exemplary embodiment of the present disclosure with a door of the exemplary washing machine appliance shown in a closed position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents. As used herein, terms of approximation, such as "approximately," "substantially," or "about," refer to being within a ten percent margin of error.

Figure 2:
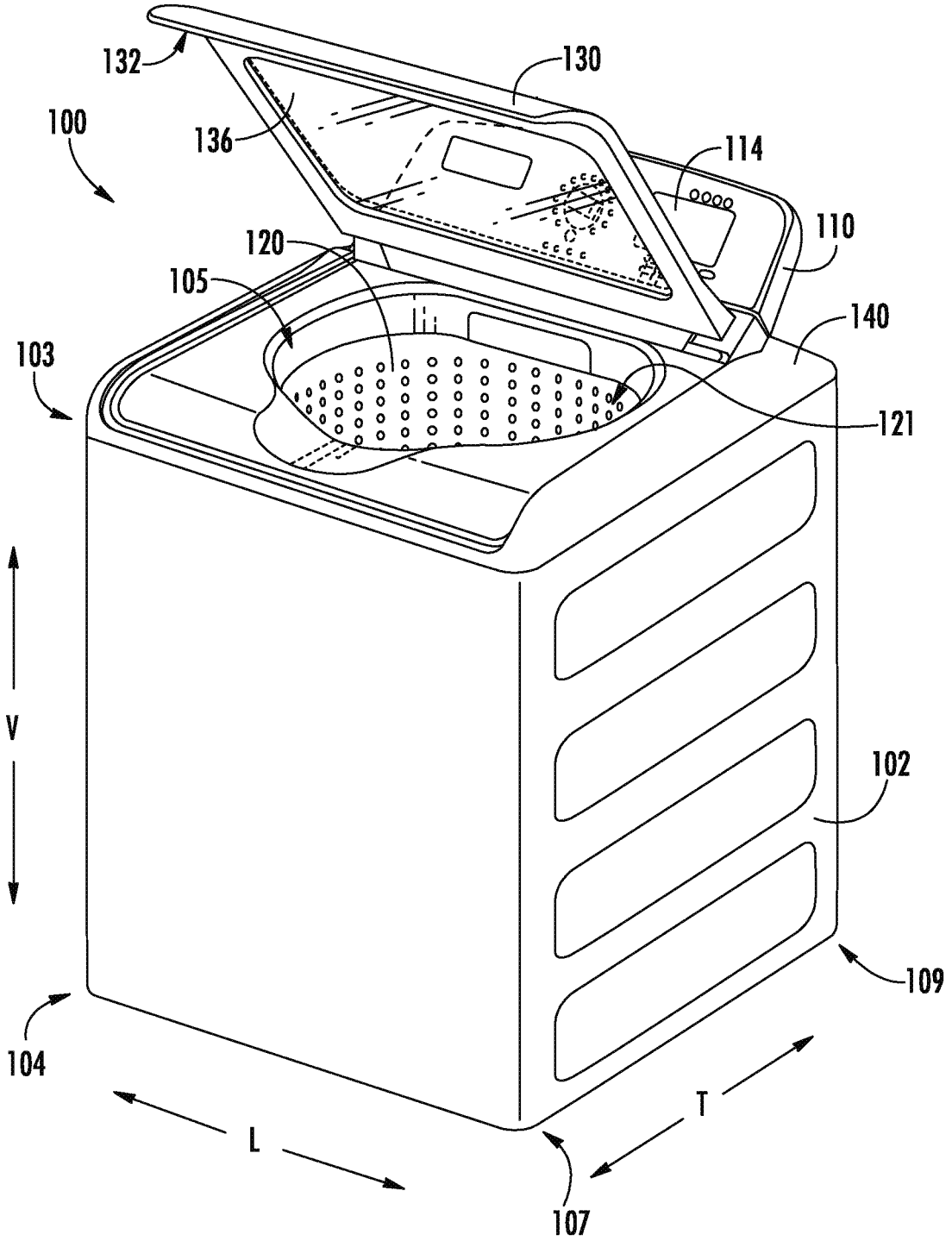
FIG. 2 provides a perspective view of the exemplary washing machine appliance of FIG. 1 with the door of the washing machine appliance shown in an open position.
Figure 3:
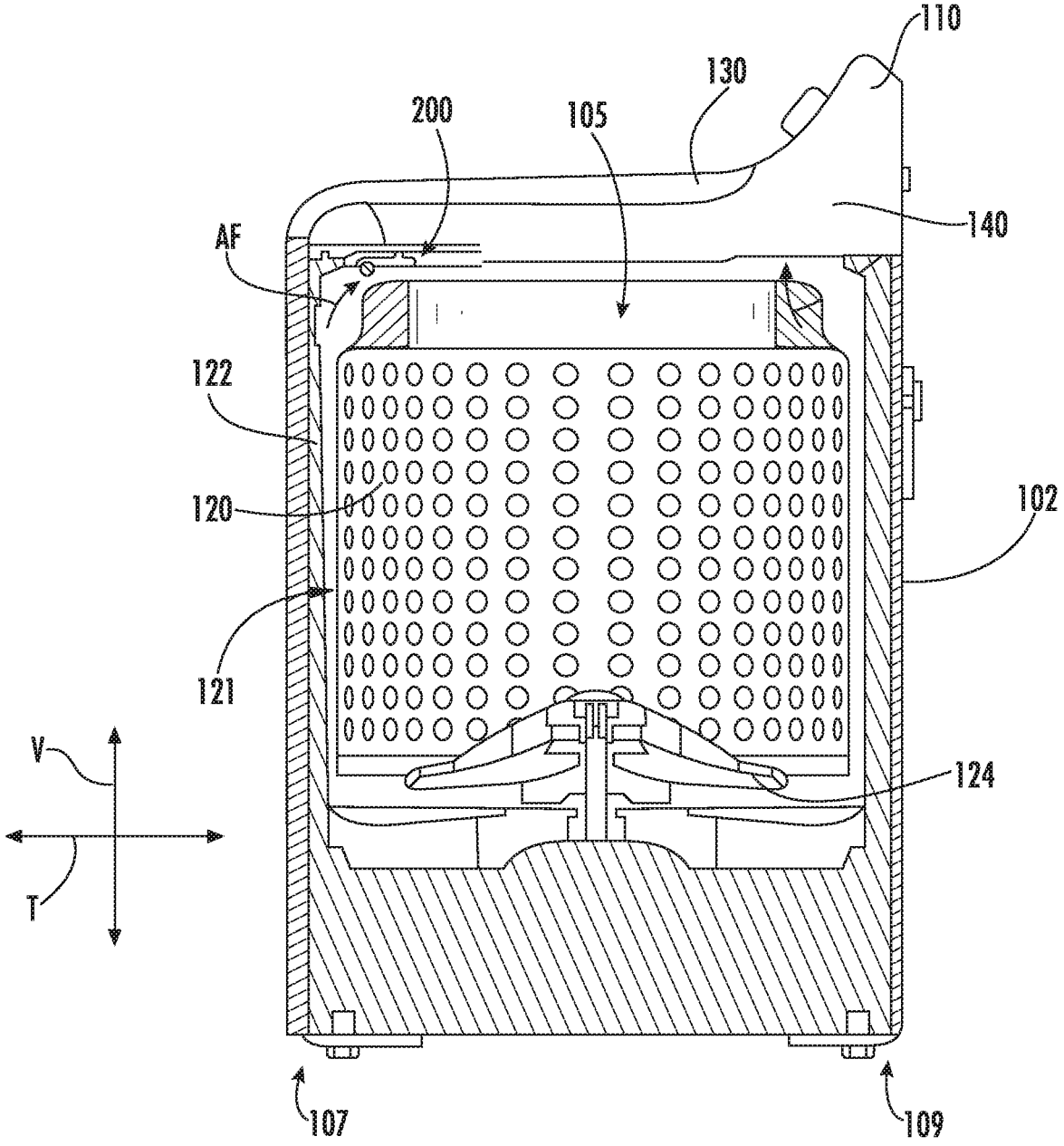
FIG. 3 provides a side cross sectional view of the washing machine appliance of FIG. 1.

FIGS. 1, 2, and 3 illustrate one exemplary appliance in which aspects of the present disclosure may be incorporated. In particular, FIGS. 1 through 3 provide an exemplary vertical axis washing machine appliance 100. In FIG. 1, a lid or door 130 of washing machine appliance 100 is shown in a closed position. In FIG. 2, door 130 is shown in an open position. FIG. 3 provides a side cross-sectional view of the washing machine appliance of FIGS. 1 and 2. As shown in FIGS. 1 and 2, washing machine appliance 100 defines a vertical direction V, a lateral direction L, and a transverse direction T, each of which is mutually perpendicular such that an orthogonal coordinate system is defined.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the teachings of the present disclosure as well, e.g., horizontal axis washing machines. Further, as will be described herein, the teachings of the present disclosure are applicable and may be incorporated in other types of appliances, such as e.g., a dryer appliance.

With reference to FIGS. 1 and 2, washing machine appliance 100 has a cabinet 102 that extends between a top portion 103 and a bottom portion 104 along the vertical direction V and between a front 107 and a back 109 along the transverse direction T. A wash basket 120 (FIGS. 2 and 3) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash chamber 121 (FIGS. 2 and 3) defined by a tub 122 (FIG. 3) positioned within cabinet 102. Wash basket 120 is configured for receipt of articles for washing. Tub 122 holds wash and rinse fluids for agitation in wash basket 120 within chamber 121. An agitator or impeller 124 extends into wash basket 120 and is also in mechanical communication with the motor. The impeller 124 facilitates agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of chamber 121. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support member.

A control panel 110 with at least one input selector 112 (FIG. 1) extends from top panel 140. Control panel 110 and input selector 112 collectively form a user interface for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 108 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are loaded into wash basket 120 through opening 105, and washing operation is initiated through operator manipulation of input selectors 112. Wash basket 120 is filled with water and detergent and/or other fluid additives via additive delivery assembly 200, which will be described in detail below. One or more valves can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

As shown in FIG. 3, washing machine appliance 100 includes an additive delivery assembly 200 for delivering an additive to chamber 121. For instance, the additive may be an aromatic agent and additive delivery assembly 200 is configured to deliver or facilitate delivery of the aromatic to the chamber 121, e.g., to provide a desired scent or smell to the chamber 121 and any articles disposed therein. For this embodiment, additive delivery assembly 200 is positioned within top panel 140 of washing machine appliance 100 and is configured to interface with the chamber 121 so that an additive may be delivered or dispensed into the chamber 121. In alternative exemplary embodiments, additive delivery assembly 200 may be positioned in other suitable locations, e.g., at back 109 of top panel 140 or at a bottom portion of tub 122. Exemplary embodiments of additive delivery assembly 200 are provided below.

Figure 4:
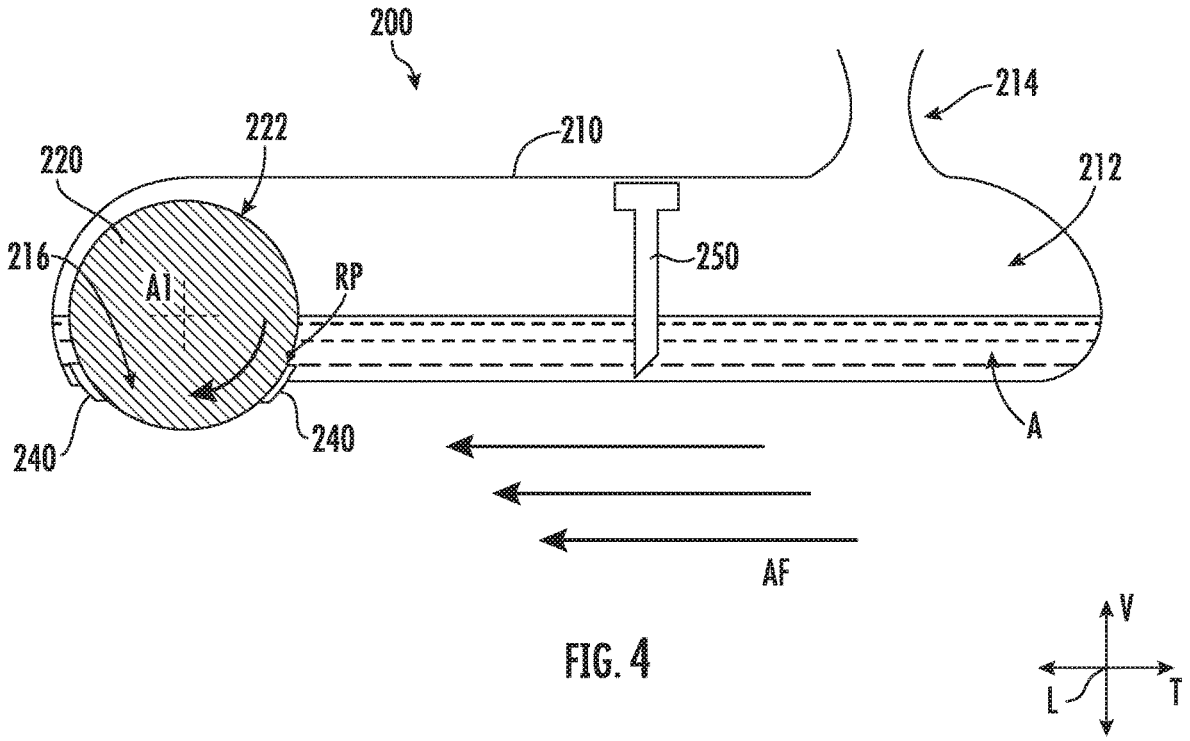
FIG. 4 provides a side cross sectional view of an exemplary additive delivery assembly according to an exemplary embodiment of the present disclosure and depicts a roller of the additive delivery assembly in a first position.
Figure 5:
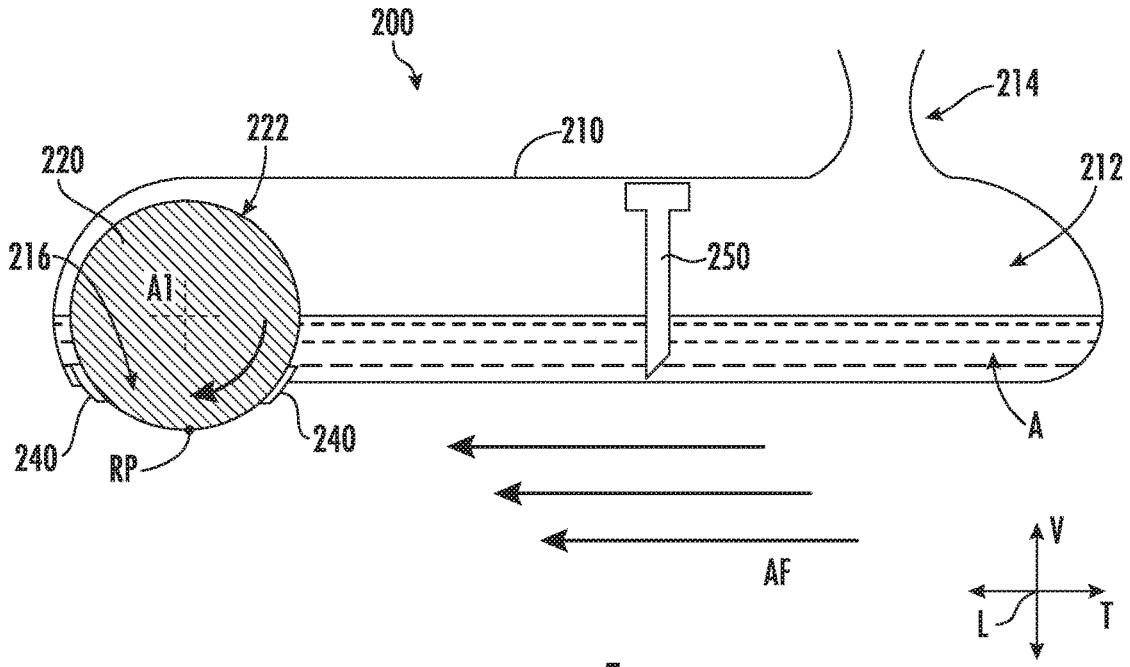
FIG. 5 provides a side cross sectional view of the additive delivery assembly of FIG. 4 depicting the roller of the additive delivery assembly in a second position.

FIGS. 4 and 5 provide various views of additive delivery assembly 200 according to an exemplary embodiment of the present disclosure. In particular, FIG. 4 provides a side cross sectional view of additive delivery assembly 200 depicting a roller 220 of additive delivery assembly 200 in a first position and FIG. 5 provides a side cross sectional view of additive delivery assembly 200 depicting roller 220 of additive delivery assembly 200 in a second position. As depicted in FIGS. 4 and 5, additive delivery assembly 200 includes a vessel or tank 210 defining a tank volume 212 configured for receipt of an additive A. As noted above, additive A may be any suitable fluid, e.g., a liquid aromatic agent as shown in FIG. 4 or a cleaning agent. Tank 210 includes a funnel 214 positioned at the top side of tank 210. Funnel 214 defines an inlet to tank 210, e.g., to provide access to tank 210 for replenishing additive A when the additive level is low. Tank 210 also defines an opening 216 at a bottom side of tank 210.

Figure 6:
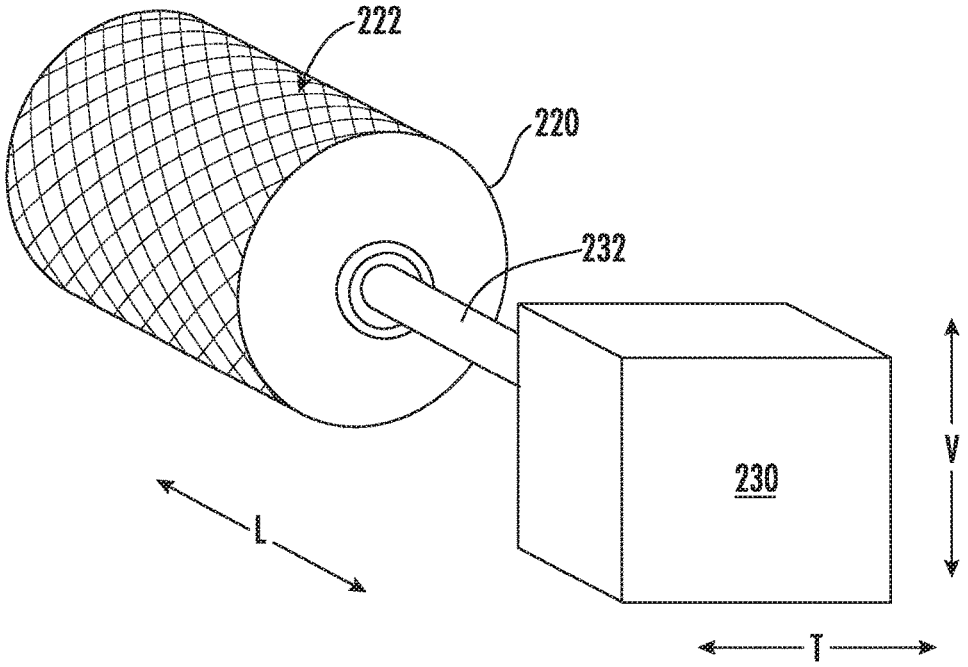
FIG. 6 provides a schematic perspective view of a motor in mechanical communication with the roller of the additive delivery assembly of FIGS. 4 and 5.

In addition, additive delivery assembly 200 includes a roller 220 that is situated or positioned at opening 216 of tank 210. As shown in FIGS. 4 and 5, roller 220 is positioned at opening 216 such that a portion of roller 220 is positioned outside of or external to tank volume 212 and a portion of roller 220 is positioned within tank volume 212. Further, for this embodiment, roller 220 is a cylinder. However, in alternative embodiments, roller 220 may be one or more balls aligned along the lateral direction L, one or more spheres, or other rolling elements preferably having a generally circular cross section. Roller 220 has a surface 222. Surface 222 may be a smooth surface or may have dimples, depressions, knurling, etching, or some other varying surface geometry. Such varying surfaces may allow additive A to better "attach" to surface 222 of roller 220. In one preferred embodiment, surface 222 of roller 220 has a diamond knurling, e.g., as shown in FIG. 6.

Moreover, as depicted, surface 222 of roller 220 defines a reference point RP. As roller 220 is a cylindrical rolling element in this embodiment, surface 222 extends three hundred sixty degrees (360°) about an axis of rotation A1 defined by roller 220. For this embodiment, the axis of rotation A1 extends along the lateral direction L but it will be appreciated that the axis of rotation A1 may extend along other directions in alternative embodiments, such as e.g., the transverse direction T. Reference point RP may be any point along surface 222 of roller 220. As shown in FIG. 4, when roller 220 is in the first position, reference point RP is shown as a point along surface 222 positioned at about four (4) o'clock with reference to the hour numerals of a clock face. As shown in FIG. 5, when roller 220 is in the second position (after being rotated about the axis of rotation A1 sixty degrees (60°)), reference point RP is shown positioned at six (6) o'clock with reference to the hour numerals of a clock face. Thus, when roller 220 is in the first position (FIG. 4), the reference point RP of surface 222 is submerged in or exposed to the additive A within tank 210, and when roller 220 is in the second position (FIG. 5), surface 222 of roller 220 is exposed to and extends into a chamber of the appliance, such as e.g., chamber 121 of washing machine appliance 100. As will be explained in greater detail below, when roller 220 is rotated about the axis of rotation A1 from the first position to the second position, the additive A disposed on surface 222 of roller 220 at the reference point RP is exposed to an airflow AF flowing in chamber 121 of washing machine appliance 100.

As further shown in FIGS. 4 and 5, one or more sealing elements 240 are positioned at opening 216 and are disposed between roller 220 and tank 210. As shown, sealing elements 240 are shaped complementary to the curvature of roller 220. In this way, sealing elements 240 contain the additive A within tank 210 even as roller 220 rotates about the rotation axis A1. Sealing elements 240 may be formed of any suitable sealing material, such as e.g., an elastic rubber material. Further, in some embodiments, sealing elements 240 may prevent the additive A from evaporating from tank 210, particularly in embodiments where additive delivery assembly 200 has an inverted configuration, e.g., as shown in FIG. 7.

Further, in some exemplary embodiments, additive delivery assembly 200 includes an additive level sensor 250 configured to sense a fluid level of the additive A disposed within tank 210. For instance, when additive A is a liquid, additive level sensor 250 is configured to sense a liquid level of the additive A disposed within tank 210. As one example, additive level sensor 250 is a pressure sensor. As another example, additive level sensor 250 is an infrared sensor. In some exemplary embodiments, additive level sensor 250 is communicatively coupled with a controller, e.g., controller 108. In this way, additive level sensor 250 may communicate the fluid level of additive A within tank 210 so that controller 108 may make certain determinations, such as e.g., the angular distance or angle in which to rotate roller 220 about the axis of rotation A1 to achieve the desired volume of additive within the chamber of the appliance, the rotational speed in which to rotate roller 220 about the axis of rotation A1, whether the additive A needs to be refilled or replenished, etc.

FIG. 6 provides a schematic perspective view of a motor 230 in mechanical communication with roller 220. As shown, motor 230 is mechanically coupled with roller 220 for driving roller 220 about the axis of rotation A1. For this embodiment, motor 230 is mechanically coupled with roller 220 via a shaft 232. Motor 230 is communicatively coupled with a controller or processing device, such as e.g., controller 108 of washing machine appliance 100 of FIGS. 1 through 3. When motor 230 is activated, e.g., by one or more signals from controller 108, motor converts electrically energy into mechanically energy to turn shaft 232. Shaft 232 in turn drives roller 220 about the axis of rotation A1. Based on instructions received from controller 108, motor 230 may drive roller 220 about the axis of rotation A1 at a predetermined rotational speed for a predetermined time or may rotate roller 220 about the axis of rotation a predetermined angular distance, such as e.g., fifty degrees (50°). Thus, controller 108 is configured to control a rotational speed and a rotational position of roller 220 via motor 230. In alternative exemplary embodiments, roller 220 may be manually rotated about the axis of rotation A1. For instance, washing machine appliance 100 may include a hand crank that a user may rotate to drive roller 220 about the axis of rotation A1.

Figure 7:
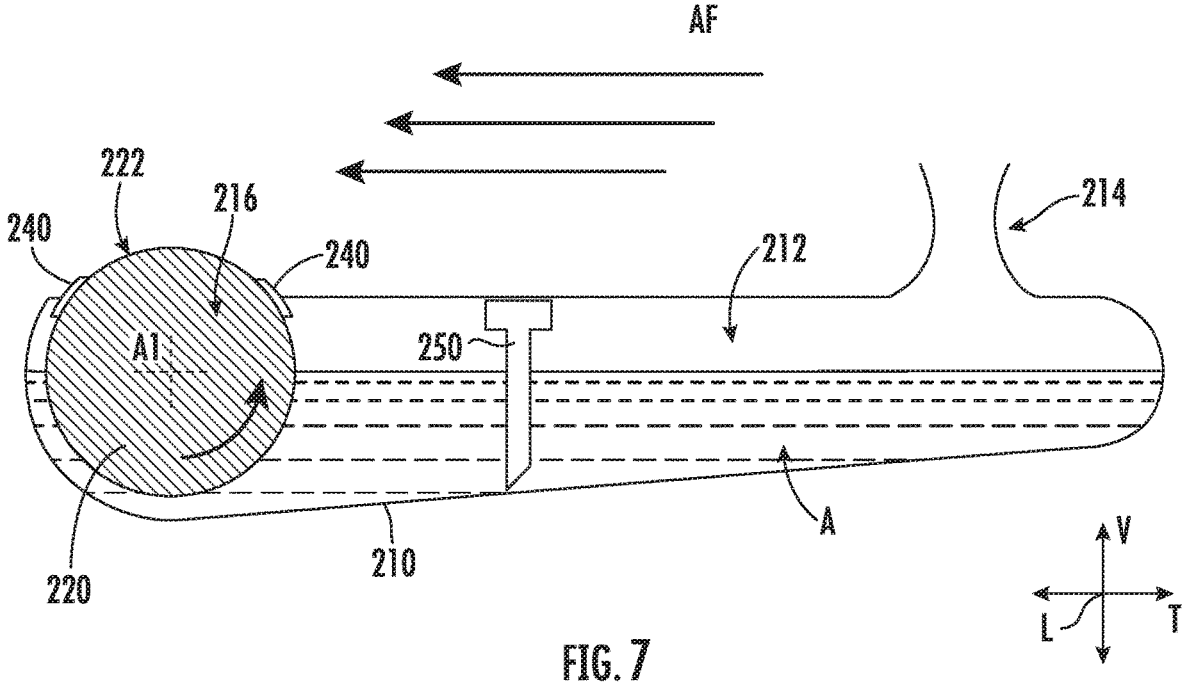
FIG. 7 provides a side cross sectional view of another exemplary embodiment of an additive delivery assembly depicting the additive delivery assembly in an inverted configuration.

FIG. 7 provides a side cross sectional view of another exemplary embodiment of additive delivery assembly 200 depicting additive delivery assembly 200 in an inverted configuration. The exemplary additive delivery assembly 200 of FIG. 7 is configured in a similar manner as the additive delivery assembly 200 of FIGS. 4 through 6, and accordingly, the same or similar numbering refers to the same or similar part.

By contrast with the additive delivery assembly of FIGS. 4 through 6, opening 216 is defined by tank 210 at the top side of tank 210, e.g., along the vertical direction V. Further, as shown in FIG. 7, roller 220 and sealing elements 240 are situated or positioned at opening 216 positioned at the top side of tank 210. In particular, for the depicted embodiment of FIG. 7, roller 220 is positioned at opening 216 such that roller 220 is positioned or extends outside of or external to tank volume 212 above tank 210 and a portion of roller 220 is positioned within tank volume 212. In this way, for example, when an airflow AF flows above additive delivery assembly 200, when additive A disposed on roller 220 is exposed to the airflow AF, the additive A is delivered or dispensed into the chamber of appliance, e.g., to produce a desirable aroma in the chamber. Further, in some exemplary embodiments, tank 210 may define one or more openings at the top side of tank 210 (as shown in FIG. 7) and one or more openings at the bottom side of tank 210 (as shown in FIGS. 4 and 5) and rollers 220 and sealing members 240 may be situated or positioned in each of the openings. In this way, additive delivery assembly 200 may utilize airflows above and below the tank 210 to deliver additive to the chamber. In yet further embodiments, tank 210 may define one or more openings in one or more of the sidewalls of tank 210 and rollers 220 and sealing members 240 may be situated or positioned in each of the openings. Operation of additive delivery assembly 200 will be explained in more detail below.

Figure 8:
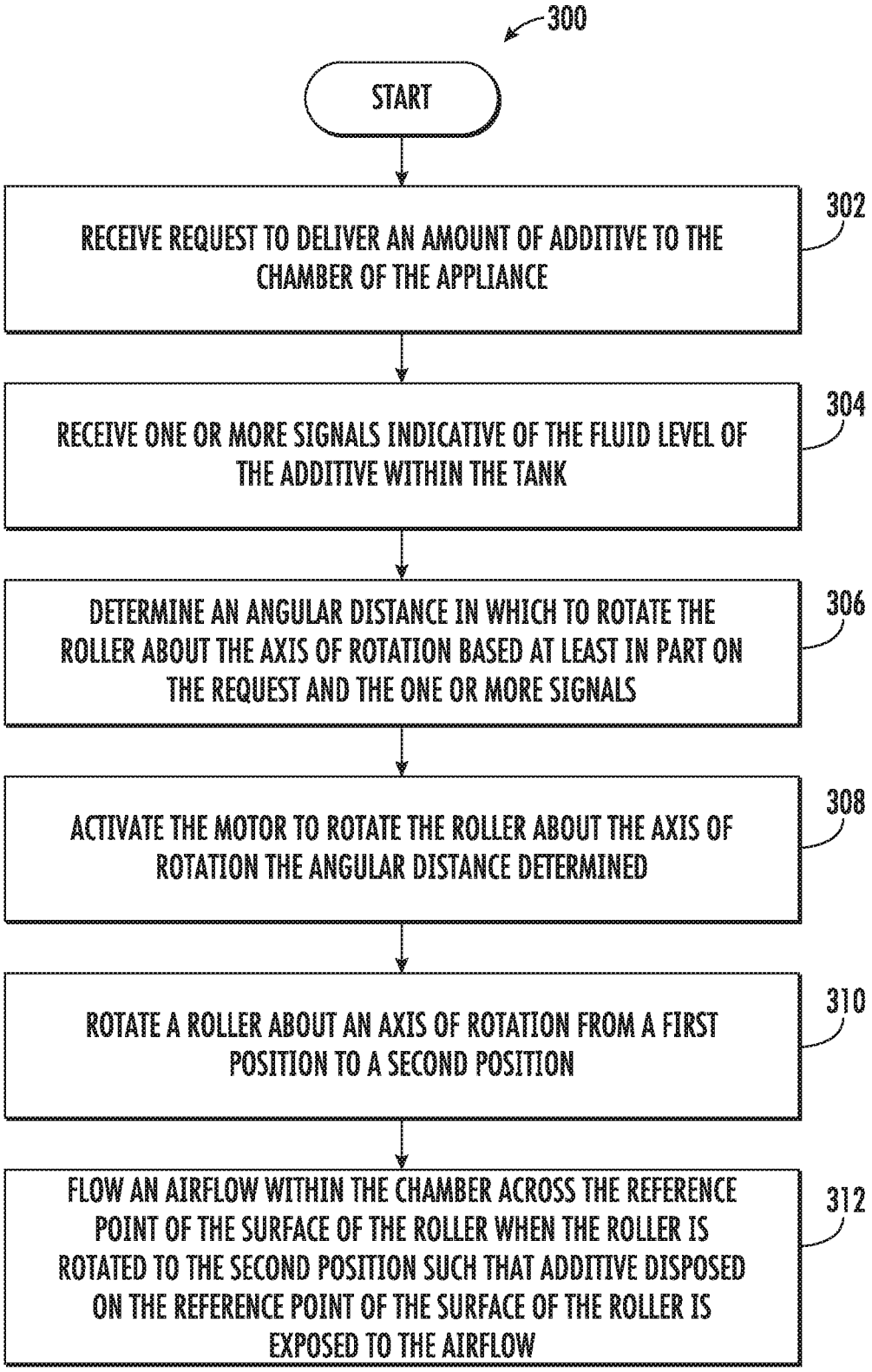
FIG. 8 provides an exemplary method for delivering an additive disposed within a tank to a chamber defined by an appliance according to an exemplary embodiment of the present disclosure.

FIG. 8 provides an exemplary method (300) for delivering an additive disposed within a tank of an additive delivery assembly to a chamber defined by an appliance according to an exemplary embodiment of the present disclosure. Method (300) can be implemented with any suitable appliance, including for example, vertical axis washing machine appliance 100 of FIGS. 1 through 3 or a dryer appliance. To provide context to method (300), reference numerals utilized to describe the features of washing machine appliance 100 in FIGS. 1 through 3 and the additive dispensing assembly 200 of FIGS. 4 through 7 will be used below.

At (302), in some implementations, method (300) includes receiving a request to deliver an amount of additive to the chamber of the appliance. For instance, controller 108 of washing machine appliance 100 may receive a request from a user or may initiate the request based on a predetermined schedule or automatic trigger. A user may request that the additive be delivered to the chamber of the appliance in a number of suitable ways. For instance, a user may manipulate one or more input selectors 112 of control panel 110. As another example, a user may request the amount of additive by utilizing an application on a remote user device communicatively coupled with controller 108 of washing machine appliance 100. Another suitable manner for requesting the delivery of additive includes automatically requesting the additive by controller 108. For example, controller 108 may be configured to automatically request delivery of additive at a predetermined interval, such as e.g., every week, every month, etc. In this manner, the additive may be delivered without user interaction with washing machine appliance 100 and it may be ensured that chamber 121 is "freshened up" with an aromatic agent at regular intervals. Other suitable manners are possible.

At (304), method (300) includes receiving one or more signals indicative of the fluid level of the additive within the tank. For instance, after additive level sensor 250 detects or senses the fluid level of the additive A within tank 210, additive level sensor 250 may generate one or more signals indicative of the fluid level of the additive A within tank 210. The one or more signals indicative of the fluid level of the additive A within tank 210 may then be routed to controller 108 of washing machine appliance 100. Controller 108 of washing machine appliance 100 may receive the one or more signals from additive level sensor 250 (either directly or indirectly through one or more circuitry components). Controller 108 may receive the one or more signals wirelessly (e.g., over a network) or through a wired connection.

At (306), method (300) includes determining an angular distance in which to rotate the roller about the axis of rotation based at least in part on the request and the one or more signals. That is, once the amount of additive A to deliver to the chamber 121 of the appliance 100 and the fluid level of the additive A within the tank 210 is known, controller 108 may determine the angular distance in which to rotate roller 220 about the axis of rotation A1. For example, if a relatively small amount of additive A is requested to be delivered to the chamber 121 of the appliance 100, then controller 108 may determine that the angular distance to rotate roller 220 to achieve the desired amount is a rotation of fifty degrees (50°) about the axis of rotation A1. However, if the liquid level within tank 210 is very low, then controller 108 may determine that the angular distance to rotate roller 220 to achieve the desired amount is a rotation of four hundred ten degrees (410°) about the axis of rotation A1 (i.e., a full rotation plus the fifty degrees (50°)). In this way, roller 220 may make a full rotation such that surface 222 is wetted or exposed to the additive A within tank 210 along its entire circumferential length. Then, to deliver the requested amount of additive A to the chamber, roller 220 is rotated about the axis of rotation A1. Further, based at least in part on the request and the one or more signals indicative of the fluid level of the additive within the tank, controller 108 may further determine a rotational speed in which to rotate roller 220 to achieve the requested amount of additive within the chamber 121 of the appliance 100. In alternative exemplary embodiments, roller 220 is rotatable about the axis of rotation A1 at a constant, single rotational speed only.

At (308), method (300) includes activating the motor to rotate the roller about the axis of rotation the angular distance determined. For instance, once the angular distance and potentially the rotational speed are determined by controller 108 at (306), controller 108 may send an activation command to motor 230 to rotate roller 220 about the axis of rotation A1.

At (310), method (300) includes rotating a roller about an axis of rotation from a first position to a second position, the roller comprising a surface that defines a reference point, the reference point of the surface is submerged in the additive disposed within the tank when the roller is rotated about the axis of rotation to the first position and the reference point of the surface is exposed to the chamber when the roller is rotated about the axis of rotation to the second position. For instance, once motor 230 is activated at (308), shaft 232 mechanically coupling motor 230 with roller 220 drives roller 220 such that it rotates about the axis of rotation A1. In particular, roller 220 is rotated about the axis of rotation A1 from a first position (e.g., FIG. 4) to a second position (e.g., FIG. 5). More particularly still, surface 222 of roller 220 defines reference point RP, as noted previously. As shown in FIGS. 4 and 5, when roller 220 is in the first position, reference point RP of surface 222 is submerged in (or more broadly exposed to) the additive A disposed within tank 210. When roller 220 is in the second position, reference point RP of surface 222 is exposed to the chamber of the appliance 100. Thus, when roller 220 is rotated from the first position to the second position, the additive A disposed on surface 222 at the reference point RP (when roller 220 is in the first position) becomes exposed to the chamber of the appliance (when roller 220 is in the second position). As discussed below at (312), the additive disposed on surface 222 of roller 220 that is exposed to chamber 121 of appliance 100 may then be delivered to the chamber 121 by an airflow.

At (312), method (300) includes flowing an airflow within the chamber across the reference point of the surface of the roller when the roller is rotated to the second position such that additive disposed on the reference point of the surface of the roller is exposed to the airflow. For instance, in some implementations, flowing an airflow includes operating an appliance such that a drum or basket of the appliance rotates about to generate an airflow. For example, as shown in FIG. 2, washing machine appliance 100 is shown in operation and rotating basket 120, e.g., about the vertical direction V. As the basket 120 rotates, airflow AF is generated. As the generated airflow AF flows past or across additive delivery assembly 200, as shown best in FIG. 5, the additive A disposed on roller 220 is exposed to airflow AF. When the additive A disposed on roller 220 is exposed to the airflow AF, the additive may be vaporized or otherwise carried off by airflow AF and thus delivered to chamber 121 of the appliance 100. Precise control and small amounts of additive may be delivered to the chamber of an appliance by rotating roller a particular angular distance, at a particular rotational speed, and by knowing the fluid level of the additive in the tank.

Figure 9:
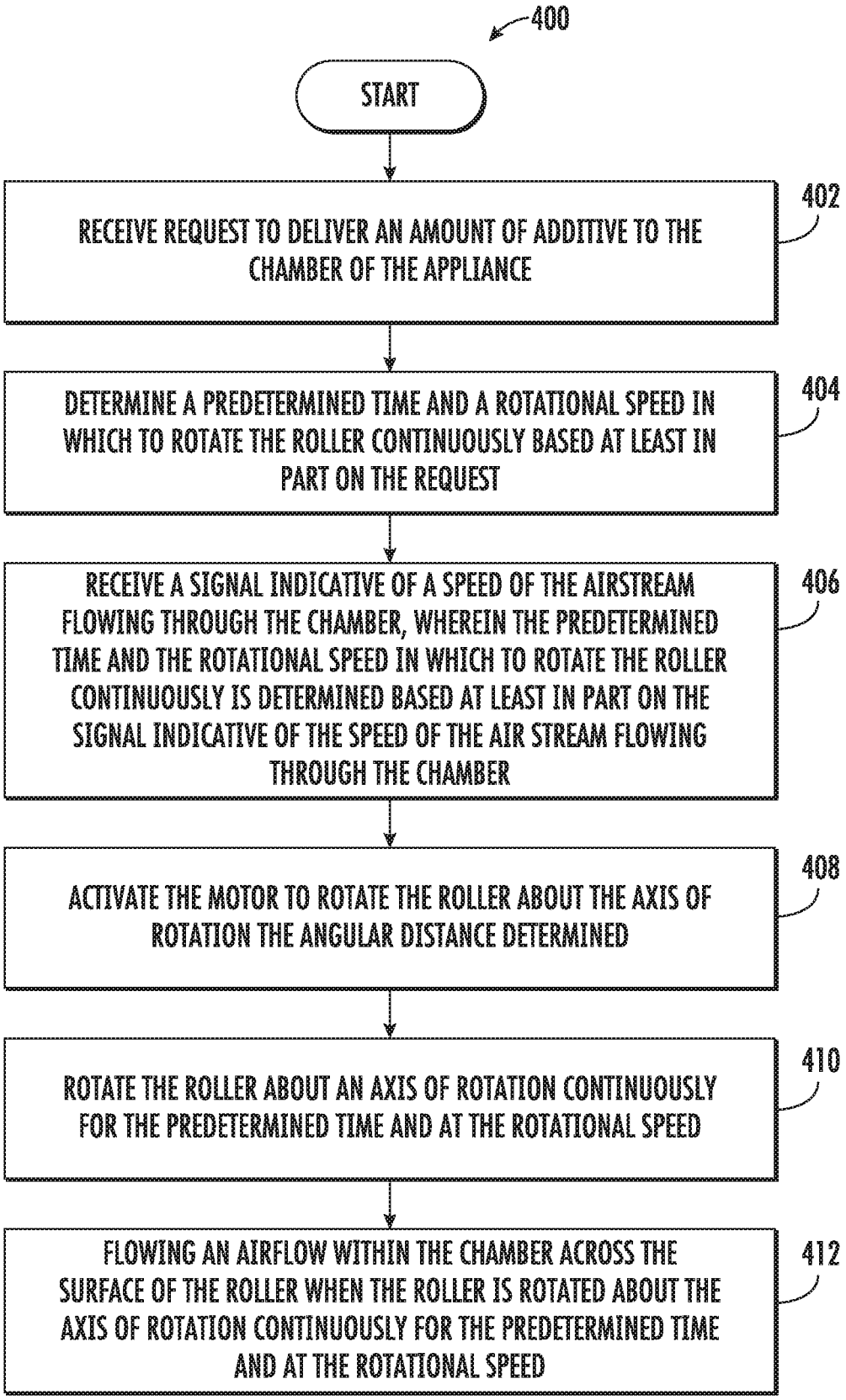
FIG. 9 provides another exemplary method for delivering an additive disposed within a tank to a chamber defined by an appliance according to an exemplary embodiment of the present disclosure.

FIG. 9 provides another exemplary method (400) for delivering an additive disposed within a tank of an additive delivery assembly to a chamber defined by an appliance according to an exemplary embodiment of the present disclosure. Method (400) can be implemented with any suitable appliance, including for example, vertical axis washing machine appliance 100 of FIGS. 1 through 3 or a dryer appliance. To provide context to method (400), reference numerals utilized to describe the features of washing machine appliance 100 in FIGS. 1 through 3 and the additive dispensing assembly 200 of FIGS. 4 through 7 will be used below.

At (402), method (400) includes receiving a request to deliver an amount of additive to the chamber of the appliance. For instance, controller 108 of washing machine appliance 100 may receive a request from a user or may initiate the request based on a predetermined schedule or automatic trigger. A request may be made to deliver an amount of additive to the chamber of the appliance in any suitable fashion, such as, e.g., one of the ways noted above at (302) of method (300).

In some implementations of method (400), the request received at (402) may include instructions to deliver additive to a chamber of an appliance in droplet form, e.g., in liquid form. Accordingly, in such implementations, roller 220 may be rotated about the axis of rotation A1 in such a way that at least some of the additive exposed to the airflow does not vaporize. That is, roller 220 may be rotated about the axis of rotation A1 in such a way that at least some of the additive exposed to the airflow remains in liquid form as additive droplets. In such implementations, as one example, roller 220 is rotated about the axis of rotation A1 continuously for a predetermined time.

At (404), in some implementations, method (400) includes determining a predetermined time and a rotational speed in which to rotate the roller continuously about the axis of rotation based at least in part on the request. That is, knowing the requested amount of additive to deliver to the chamber, the rotational speed in which to rotate roller 220 and the rotational speed in which to rotate roller 220 are determined by controller 108 to achieve the desired amount of additive to the chamber of the appliance.

At (406), in some implementations, method (400) includes receiving a signal indicative of a speed of the airflow flowing through the chamber, wherein the predetermined time and the rotational speed in which to rotate the roller continuously is determined based at least in part on the signal indicative of the speed of the airflow flowing through the chamber. As one example, the controller 108, knowing the rotational speed of the basket 120 rotating within the chamber 121, may predict the speed of the airflow flowing through chamber 121. Signals indicative of such predictions may be received by controller 108, e.g., by a processing device of controller 108. As another example, a flow sensor configured for sensing the speed of airflows flowing through the chamber 121 of the appliance 100 may be positioned within the tub 122 of the appliance 100. In preferred embodiments, the flow sensor is positioned adjacent the additive delivery assembly 200. Signals generated by the flow sensor indicative of the speed of airflows flowing through chamber 121 may be received by controller 108. Based on the signal indicative of the speed of airflows flowing through the chamber, controller 108 may utilize the signals to make determinations as to the predetermined time and the rotational speed in which to rotate roller 220 continuously about the axis of rotation A1. For instance, for faster moving airflows, the additive exposed to the airflow may be more likely to vaporize upon exposure to the fast moving airflow, and thus, to deliver the requested amount of additive in droplet or liquid form, the rotational speed of the roller 220 may need to be set to a greater rotational speed. In contrast, for slower moving airflows, the additive exposed to the airflow may be less likely to vaporize upon exposure to the slow moving airflow, and thus, to deliver the requested amount of additive in droplet or liquid form, the rotational speed of the roller 220 may need to set to a lesser rotational speed.

At (408), method (400) includes activating the motor to rotate the roller about the axis of rotation at the rotational speed determined. Further, at (408) controller 108 may start a timer to track the time in which motor is in operation to rotate roller 220. In this way, it may be ensured that roller 220 is rotated for the determined predetermined time. Once the rotational speed and the predetermined time are determined by controller 108 at (404), controller 108 may send an activation command to motor 230 to rotate roller 220 about the axis of rotation A1.

At (410), method (400) includes rotating the roller about an axis of rotation continuously for the predetermined time and at the rotational speed. For instance, once motor 230 is activated at (408), shaft 232 mechanically coupling motor 230 with roller 220 drives roller 220 such that it rotates about the axis of rotation A1 continuously for the predetermined time and at the rotational speed. In some implementations, to deliver the additive A within tank 210 to the chamber 121 of the appliance 100 in more of a liquid or additive droplet state, roller 220 is rotated about the axis of rotation A1 continuously for the predetermined time at a rotational speed of greater than about one hundred revolutions per minute (100 RPM). In this way, the additive A exposed to the airflow is more likely to saturate the airflow and/or not vaporize, and accordingly, additive A may be delivered to the chamber 121 of the appliance 100 in a liquid or additive droplet state. In other embodiments, roller 220 is rotated about the axis of rotation A1 continuously for the predetermined time at a rotational speed of greater than about eighty revolutions per minute (80 RPM). When roller 220 is rotated about the axis of rotation A1 continuously for the predetermined time and at the rotational speed, the additive A disposed on surface 222 becomes exposed to the chamber of the appliance. As discussed below at (412), the additive disposed on surface 222 of roller 220 that is exposed to chamber 121 of appliance 100 may then be delivered to the chamber 121 by an airflow.

At (412), method (400) includes flowing an airflow within the chamber across the surface of the roller when the roller is rotated about the axis of rotation continuously for the predetermined time and at the rotational speed. When roller 220 is rotated about the axis of rotation A1 continuously for the predetermined time and at the rotational speed, the additive disposed on surface 222 of roller 220 is exposed to the airflow, and thus, the additive is delivered to the chamber 121 of the appliance 100. As noted above, particularly when roller 220 is rotated at rotational speed exceeding eighty revolutions per minute (80 RPM), at least some of the additive A delivered to the chamber 121 is delivered in droplet or liquid form. The airflow flowing through or within chamber 121 facilitates delivery of the additive to the various regions of the chamber 121.

As noted above, in some implementations of methods (300) or (400), the appliance in which additive delivery assembly 200 may deliver additive to the chamber may be a dryer appliance. One exemplary dryer appliance in which additive delivery assembly 200 may be incorporated is provided below.

Figure 10:
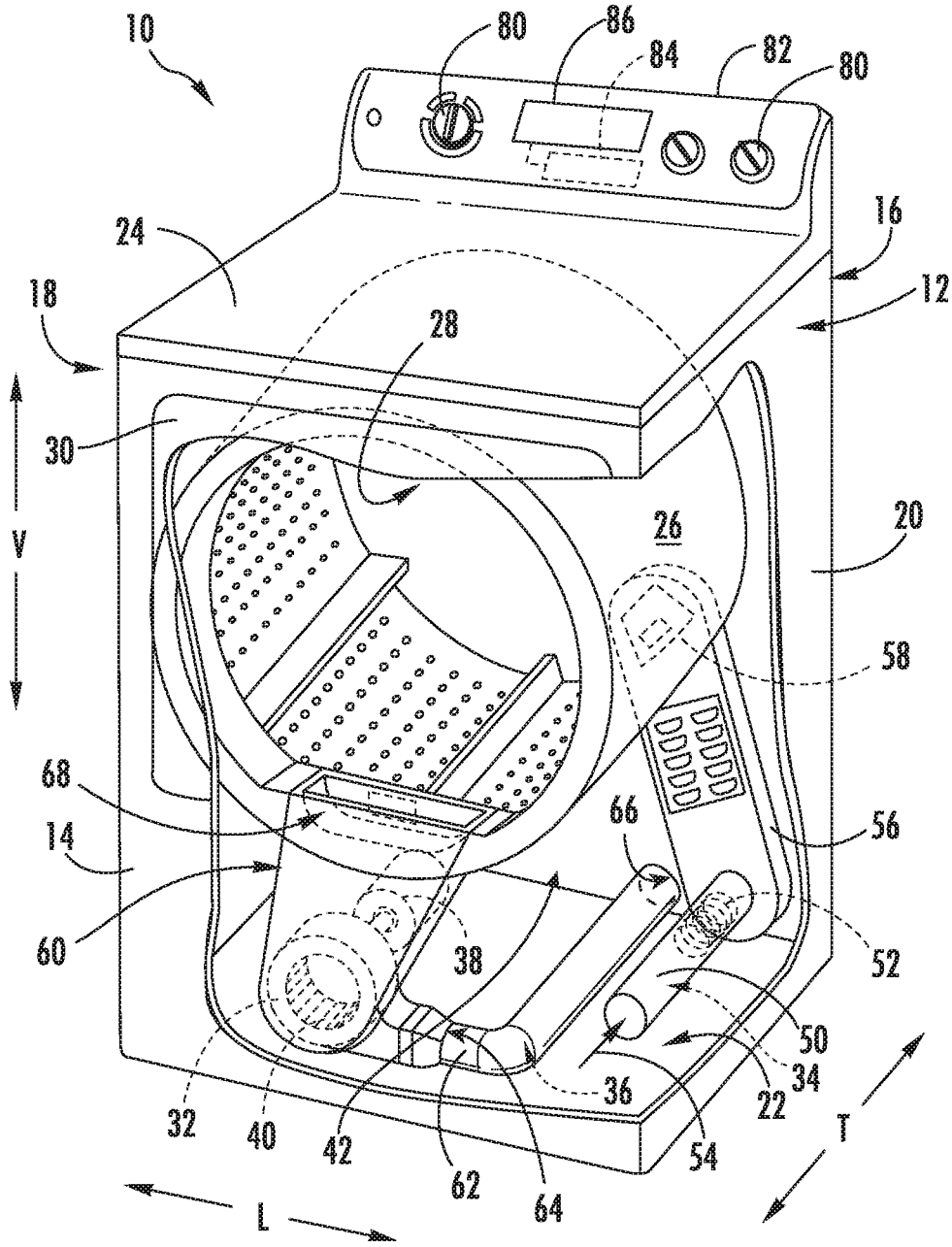
FIG. 10 provides a perspective view of an exemplary dryer appliance with portions of a cabinet of the dryer appliance removed to reveal certain components of the exemplary dryer appliance according to an exemplary embodiment of the present disclosure.

FIG. 10 provides a perspective view of an exemplary dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other dryer appliances having different appearances and different features may also be utilized with the present subject matter as well.

Dryer appliance 10 defines a vertical direction V, a lateral direction L, and a transverse direction T. The vertical direction V, lateral direction L, and transverse direction T are mutually perpendicular and form an orthogonal direction system. Cabinet 12 includes a front panel 14, a rear panel 16, a pair of side panels 18 and 20 spaced apart from each other by front and rear panels 14 and 16, a bottom panel 22, and a top cover 24. Cabinet 12 defines a chamber 42 in which a container or drum 26 is positioned. Drum 26 defines a drying chamber 28 for receipt of articles, e.g., clothing, linen, etc., for drying. Drum 26 extends between a front portion and a back portion, e.g., along the transverse direction T. In example embodiments, drum 26 is rotatable, e.g., about an axis that is parallel to the transverse direction T, within cabinet 12. A door 30 is rotatably mounted to cabinet 12 for providing selective access to drum 26.

An air handler 32 is provided to motivate an airflow through an entrance air passage 34 and an air exhaust passage 36. Specifically, air handler 32 includes a motor 38 in mechanical communication with a blower fan 40 of air handler 32 such that motor 38 rotates blower fan 40. Air handler 32 is configured for drawing air through drying chamber 28 of drum 26, e.g., in order to dry articles located therein. In alternative example embodiments, dryer appliance 10 may include an additional motor (not shown) for rotating fan 40 of air handler 32 independently of drum 26.

Drum 26 is configured to receive heated air that has been heated by a heating assembly 50, e.g., in order to dry damp articles disposed within drying chamber 28 of drum 26. Heating assembly 50 includes a heater 52 that is in thermal communication with drying chamber 28. For instance, heater 52 may include one or more electrical resistance heating elements or gas burners, for heating air being flowed to drying chamber 28. As discussed above, during operation of dryer appliance 10, motor 38 rotates fan 40 of air handler 32 such that air handler 32 draws air through drying chamber 28 of drum 26. In particular, ambient air enters an air entrance passage defined by heating assembly 50 via an entrance 54 due to air handler 32 urging such ambient air into entrance 54. Such ambient air is heated within heating assembly 50 and exits heating assembly 50 as heated air. Air handler 32 draws such heated air through an air entrance passage 34, including inlet duct 56, to drum 26. The heated air enters drum 26 through an outlet 58 of duct 56 positioned at a rear wall of drum 26.

Within drying chamber 28, the heated air can remove moisture, e.g., from damp articles disposed within drying chamber 28. This internal air flows in turn from drying chamber 28 through an outlet assembly positioned within cabinet 12. The outlet assembly generally defines air exhaust passage 36 and includes a vent duct 60, air handler 32, and an exhaust conduit 62. Exhaust conduit 62 is in fluid communication with vent duct 60 via air handler 32. More specifically, exhaust conduit 62 extends between an exhaust inlet 64 and an exhaust outlet 66. According to the illustrated embodiment, exhaust inlet 64 is positioned downstream of and fluidly coupled to air handler 32, and exhaust outlet 66 is defined in rear panel 16 of cabinet 12. During a dry cycle, internal air flows from drying chamber 28 through vent duct 60 to air handler 32, e.g., as an outlet flow portion of airflow. As shown, air further flows through air handler 32 and to exhaust conduit 62.

The internal air is exhausted from dryer appliance 10 via exhaust conduit 62. In some embodiments, an external duct (not shown) is provided in fluid communication with exhaust conduit 62. For instance, the external duct may be attached (e.g., directly or indirectly attached) to cabinet 12 at rear panel 16. Any suitable connector (e.g., collar, clamp, etc.) may join the external duct to exhaust conduit 62. In residential environments, the external duct may be in fluid communication with an outdoor environment (e.g., outside of a home or building in which dryer appliance 10 is installed). During a dry cycle, internal air may thus flow from exhaust conduit 62 and through the external duct before being exhausted to the outdoor environment.

In exemplary embodiments, vent duct 60 may include a filter portion 68 that includes a screen filter or other suitable device for removing lint and other particulates as internal air is drawn out of drying chamber 28. The internal air is drawn through filter portion 68 by air handler 32 before being passed through exhaust conduit 62. After the clothing articles have been dried (or a drying cycle is otherwise completed), the clothing articles are removed from drum 26, e.g., by accessing drying chamber 28 by opening door 30. The filter portion 68 may further be removable such that a user may collect and dispose of collected lint between drying cycles.

One or more selector inputs 80, such as knobs, buttons, touchscreen interfaces, etc., may be provided on a cabinet backsplash 82 and may be in communication with a processing device or controller 84. Signals generated in controller 84 operate motor 38, heating assembly 50, and other system components in response to the position of selector inputs 80. Additionally, a display 86, such as an indicator light or a screen, may be provided on cabinet backsplash 82. Display 86 may be in communication with controller 84 and may display information in response to signals from controller 84. For instance, controller 84 may communicate a low fluid level of additive in a tank of an additive delivery assembly 200 (FIG. 11) positioned in dryer appliance 10.

In addition, dryer appliance 10 may include one or more airflow sensors 92 which are generally operable to detect the velocity of air (e.g., as an airflow rate in meters per second, or as a volumetric velocity in cubic meters per second) as it flows through the appliance 10. According to the illustrated embodiment, airflow sensor 92 is at least partially positioned within inlet duct 56, e.g., at or proximal to an inlet of drum 26. Additionally or alternatively, airflow sensor 92 may be positioned at another suitable location, such as within exhaust conduit 62, vent duct 60, and/or another portion of inlet duct 56. Airflow sensor 92 may be embodied by any suitable configuration (e.g., mechanical flow meter, pressure-based meter, optical meter, etc.), such as a Pitot tube or a set of dual static-pressure taps connected to a pressure transducer. When assembled, airflow sensor 92 may be in communication with (e.g., electrically coupled to) controller 84, and may transmit readings to controller 84 as required or desired.

Figure 11:
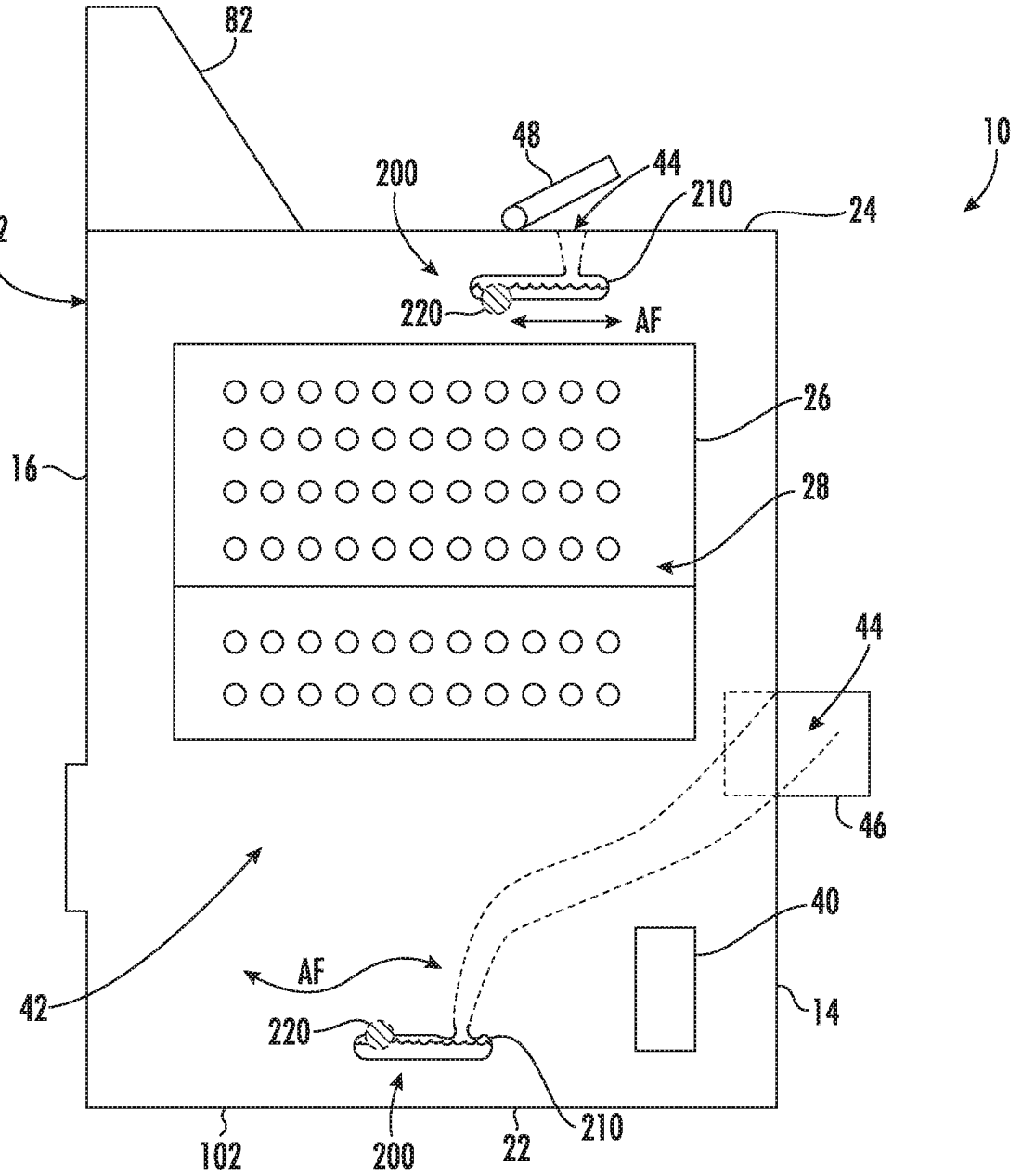
FIG. 11 provides a schematic view of additive delivery assemblies in the dryer appliance of FIG. 10.

FIG. 11 provides a schematic view of additive delivery assemblies 200 in the dryer appliance 10 of FIG. 10. As shown in FIG. 11, dryer appliance 10 includes a pair of additive delivery assemblies 200, including a first or top additive delivery assembly 200 positioned at a top portion of cabinet 12 of dryer appliance 10 and a second or bottom additive delivery assembly 200 positioned at a bottom portion of cabinet 12 of dryer appliance 10. In accordance with exemplary aspects of the present disclosure, additive delivery assemblies 200 are positioned such that they are configured to deliver an additive to chamber 42 and dryer chamber 28. The airflow that may facilitate delivery of the additive to the chamber 42 or drying chamber 28 may be generated by any suitable component within dryer appliance 10. For instance, according to an exemplary embodiment, drum 26 may generate an airflow as it rotates or spins about its axis. As shown in FIG. 11, as drum 26 spins about its axis, airflow AF is generated. Airflow AF may flow across roller 220 of first additive delivery assembly 200 positioned at the top of cabinet 12. As further shown in FIG. 11, the second additive delivery assembly 200 positioned at a bottom portion of chamber 42 of cabinet 12 may be positioned within chamber 42 such that the airflow that is generated to facilitate delivery of the additive to chamber 42 and drying chamber 28 is generated by blower fan 42 of dryer appliance 10. For instance, second additive delivery assembly 200 may be positioned at or near entrance 54 of heating assembly 50 (FIG. 2), and as air is urged into entrance 54 by blower fan 40 of air handler 32, the airflow AF may flow across roller 220 of second additive delivery assembly 200. As another example, second additive delivery assembly 200 may be positioned below drum 26, e.g., along the vertical direction V and the airflow AF utilized to facilitate delivery of additive to chamber 42 and drying chamber 28 may be generated by a combination of the rotation of drum 26 and blower fan 40.

Further, dryer appliance 10 may include one or more refill inlets 44 through which an additive may be introduced or resupplied to tanks 210 of additive delivery assemblies 200. Specifically, referring for example to FIG. 11, refill inlets 44 may be a sliding drawer 46 positioned on front panel 14 of the cabinet 12 or may be a hinged door 48 positioned on top cover 24 of cabinet 12. Although two exemplary refill inlets 44 are described herein, it should be appreciated that any suitable position, type, and configuration of refilling mechanisms are possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An additive delivery assembly for an appliance, the appliance defining a chamber in which an airflow is configured to flow, the additive delivery assembly comprising:

a tank defining a tank volume configured for receipt of an additive; and a roller configured for rotation about an axis of rotation, the roller comprising a surface that defines a reference point that is exposed to the additive disposed within the tank when the roller is in a first position and the reference point of the surface is exposed to the chamber when the roller is in a second position, and wherein when the roller is rotated about the axis of rotation from the first position to the second position, the additive disposed on the surface of the roller at the reference point is exposed to the airflow flowing in the chamber of the appliance;

a motor mechanically coupled with the roller for driving the roller about the axis of rotation;

a controller communicatively coupled with the motor, and wherein the controller is configured to:

receive a request to deliver an amount of the additive to the chamber of the appliance;

receive one or more signals indicative of a liquid level of the additive within the tank;

determine an angular distance in which to rotate the roller about the axis of rotation based at least in part on the one or more signals; and activate the motor to rotate the roller about the axis of rotation the determined angular distance.

2. The additive delivery assembly of claim 1, wherein the appliance is a washing machine appliance.

3. The additive delivery assembly of claim 1, further comprising:

an additive level sensor communicatively coupled with the controller and configured to sense the liquid level of the additive disposed within the tank.

4. The additive delivery assembly of claim 1, wherein the roller is rotated continuously about the axis of rotation for a predetermined time at a predetermined rotational speed.

5. The additive delivery assembly of claim 1, wherein the surface of the roller is knurled.

6. The additive delivery assembly of claim 1, wherein when the roller is in the first position, the reference point of the surface is submerged in the additive within the tank, and when the roller is in the second position, the reference point of the surface extends into and is exposed to the chamber of the appliance.

7. The additive delivery assembly of claim 1, wherein the tank defines an opening and the roller is received within the opening, and wherein the additive delivery assembly further comprises:

a seal positioned at the opening and disposed between the roller and the tank.

8. The additive delivery assembly of claim 1, wherein the appliance is a dryer appliance.

9. A method for delivering an additive disposed within a tank to a chamber defined by an appliance, the method comprising:

receiving a request to deliver an amount of the additive to the chamber of the appliance;

receiving one or more signals indicative of a liquid level of the additive within the tank;

determining an angular distance in which to rotate the roller about the axis of rotation based at least in part on the one or more signals;

rotating the roller about an axis of rotation the determined angular distance from a first position to a second position, the roller comprising a surface that defines a reference point, the reference point of the surface is submerged in the additive disposed within the tank when the roller is rotated about the axis of rotation to the first position and the reference point of the surface is exposed to the chamber when the roller is rotated about the axis of rotation to the second position; and flowing an airflow within the chamber across the reference point of the surface of the roller when the roller is rotated to the second position such that additive disposed on the reference point of the surface of the roller is exposed to the airflow.

10. The method of claim 9, wherein the airflow is generated by rotation of a basket or drum of the appliance.

11. The method of claim 9, wherein the airflow is generated by a blower fan of a dryer appliance.

12. The method of claim 9, wherein the surface of the roller is knurled.

13. A method for delivering an additive disposed within a tank to a chamber defined by an appliance, the method comprising:

receiving a request to deliver an amount of the additive to the chamber of the appliance;

determining a predetermined time and a rotational speed to rotate a roller continuously based at least in part on the request;

receiving a signal indicative of a speed of an airflow flowing through the chamber, wherein the predetermined time and the rotational speed in which to rotate the roller continuously is determined based at least in part on the signal indicative of the speed of the airflow flowing through the chamber;

rotating the roller comprising a surface about an axis of rotation continuously for the predetermined time and at the rotational speed, wherein at least a portion of the roller is positioned within the tank and submerged in the additive and at least a portion of the roller is positioned external to the tank and within the chamber such that the additive disposed on the surface of the roller is exposed to the airflow.

14. The method of claim 13, wherein the roller is rotated about the axis of rotation continuously for the predetermined time at a rotational speed of greater than about eighty revolutions per minute (80 RPM).

15. The method of claim 13, wherein the roller is rotated about the axis of rotation continuously for the predetermined time at a rotational speed of greater than about one hundred revolutions per minute (100 RPM).

16. The method of claim 13, wherein the surface of the roller is knurled.

17. The method of claim 16, wherein the appliance is a dryer appliance.

18. The method of claim 13, wherein the appliance is a washing machine appliance.

19. The additive delivery assembly of claim 1, wherein the tank has a top side that defines an opening, and wherein the roller is received within the opening such that a portion of the roller extends external to the tank volume and a portion of the roller is positioned within the tank volume.

20. The additive delivery assembly of claim 1, wherein the tank has a bottom side that defines an opening, and wherein the roller is received within the opening such that a portion of the roller extends external to the tank volume and a portion of the roller is positioned within the tank volume.

* * * * *